US012239251B2

(12) United States Patent
Meyers et al.

(10) Patent No.: US 12,239,251 B2
(45) Date of Patent: Mar. 4, 2025

(54) DRINKING VESSEL LID WITH MAGNETIC SEALING MECHANISM

(71) Applicant: Runway Blue, LLC, Lehi, UT (US)

(72) Inventors: David O. Meyers, Layton, UT (US); John R. Omdahl, II, Lindon, UT (US); Paul James Faerber, Orem, UT (US)

(73) Assignee: Runway Blue, LLC, Lehi, UT (US)

( * ) Notice: Subject to any disclaimer, the term of this patent is extended or adjusted under 35 U.S.C. 154(b) by 633 days.

(21) Appl. No.: 17/407,802

(22) Filed: Aug. 20, 2021

(65) Prior Publication Data

US 2022/0087454 A1 Mar. 24, 2022

Related U.S. Application Data

(60) Provisional application No. 63/068,189, filed on Aug. 20, 2020.

(51) Int. Cl.

| | |
|---|---|
| ***A47G 19/22*** | (2006.01) |
| ***B65D 47/28*** | (2006.01) |
| ***B65D 47/32*** | (2006.01) |

(52) U.S. Cl.

CPC ..... *A47G 19/2272* (2013.01); *B65D 47/286* (2013.01); *B65D 47/32* (2013.01)

(58) Field of Classification Search

None

See application file for complete search history.

(56) References Cited

U.S. PATENT DOCUMENTS

| | | | |
|---|---|---|---|
| 6,390,319 | B1 | 5/2002 | Yu |
| 7,950,541 | B2 | 5/2011 | Holcomb et al. |
| 7,997,442 | B2 | 8/2011 | Pinelli |
| 8,590,731 | B2 | 11/2013 | Pinelli |
| 8,613,369 | B2 | 12/2013 | Kitto |
| 8,960,490 | B2 | 2/2015 | Carlile et al. |
| 9,889,972 | B2 | 2/2018 | Sugai |
| 9,908,687 | B2 | 3/2018 | Chiou et al. |
| 9,913,552 | B2 | 3/2018 | Elsaden et al. |
| 10,023,366 | B2 | 7/2018 | Gilbert et al. |
| 10,093,460 | B2 | 10/2018 | Seiders et al. |

(Continued)

OTHER PUBLICATIONS

International Search Report and Written Opinion of the International Searching Authority in International Application No. PCT/US2021/046898, mailed Nov. 15, 2021 (11 pages).

*Primary Examiner* — Don M Anderson

(74) *Attorney, Agent, or Firm* — Sterne, Kessler, Goldstein & Fox P.L.L.C.

(57) ABSTRACT

A lid for a drinking vessel including a lid base, a movable arm, and an actuator. The base defines a drinking opening. The arm is coupled to the base and located in an interior of the base. The actuator is accessible from an exterior of the base. A first and second magnet unit are coupled to one of the arm or actuator. A third magnet unit is coupled to the other of the arm or actuator. The arm is movable between a sealed position, in which the drinking opening is sealed, and an open position, in which the drinking opening is not sealed. The actuator is movable between a first and second position. A magnetic force maintains the arm in the open position while the actuator is in the second position, and a magnetic force maintains the arm in the sealed position while the actuator is in the first position.

22 Claims, 10 Drawing Sheets

(56) References Cited

U.S. PATENT DOCUMENTS

| | | | | |
|---|---|---|---|---|
| 10,232,993 | B2 | 3/2019 | Seiders et al. | |
| 10,364,071 | B1 | 7/2019 | Wasso, Jr. | |
| 10,421,587 | B2 | 9/2019 | Gilbert et al. | |
| 10,709,270 | B2 | 7/2020 | Joseph et al. | |
| 10,829,275 | B2 | 11/2020 | Owusu | |
| 11,560,263 | B2 | 1/2023 | Wilson | |
| 2017/0066573 | A1 | 3/2017 | Karussi et al. | |
| 2018/0127165 | A1* | 5/2018 | Smaldone | B65D 45/025 |
| 2020/0055645 | A1* | 2/2020 | Lane | A47G 19/2272 |
| 2020/0198851 | A1* | 6/2020 | Cheng | B65D 47/06 |
| 2022/0087454 | A1* | 3/2022 | Meyers | B65D 47/286 |
| 2024/0067417 | A1* | 2/2024 | Meyers | B65D 47/12 |

* cited by examiner

DRINKING VESSEL LID WITH MAGNETIC SEALING MECHANISM

CROSS-REFERENCE TO RELATED APPLICATIONS

This application claims the benefit of U.S. Provisional Patent Application No. 63/068,189, filed Aug. 20, 2020, which is incorporated herein in its entirety by reference thereto.

FIELD

This disclosure generally relates to drinking vessels for beverages. More specifically, some embodiments relate to vessels with sealing mechanisms.

BACKGROUND

It may be desirable for a drinking vessel to have a sealed position, in which a drinking opening of the drinking vessel is sealed, and an open position, in which the drinking opening is not sealed. It may also be desirable for a drinking vessel to have relatively few components that may contact a beverage contained in or consumed through the drinking vessel.

SUMMARY

Some embodiments described herein are directed to a lid for a drinking vessel including a lid base, a movable arm, and an actuator. The lid base defines a drinking opening therethrough. The movable arm is coupled to the lid base and disposed in an interior of the lid base. The actuator is accessible from an exterior of the lid base. A first magnet unit and a second magnet unit are coupled to one of the movable arm or the actuator. A third magnet unit is coupled to the other of the movable arm or the actuator. The movable arm is movable between a sealed position, in which the drinking opening is sealed, and an open position, in which the drinking opening is not sealed. The actuator is movable between a first position and a second position. A magnetic force maintains the movable arm in the open position while the actuator is in the second position, and a magnetic force maintains the movable arm in the sealed position while the actuator is in the first position.

Some embodiments described herein are directed to a lid for a drinking vessel including a lid base, a movable arm, and an actuator. The lid base defines a drinking opening therethrough. The movable arm is coupled to the lid base and located in an interior of the lid base. A first magnet unit is coupled to the movable arm. The actuator is accessible from an exterior of the lid base. A second magnet unit is coupled to the actuator. The movable arm is movable between a sealed position, in which the drinking opening is sealed, and an open position, in which the drinking opening is not sealed. The movable arm is biased toward a biased position, the biased position being one of the sealed position or the open position. The actuator is movable between a first position and a second position. When the actuator is moved to the second position, a force between the first and second magnet units overcomes the bias of the movable arm and causes the movable arm to move away from the biased position.

Some embodiments described herein are directed to a method for sealing and unsealing a drinking opening of a drinking vessel. The method includes an operation of moving an actuator accessible from an exterior of a lid base from a first position to a second position, and an operation of moving the actuator from the second position to the first position. Moving the actuator from the first position to the second position changes a magnetic force on a movable arm within the lid and thereby moves the movable arm to unseal a drinking opening of the lid base. Moving the actuator from the second position to the first position changes the magnetic force on the movable arm and thereby moves the movable arm to seal the drinking opening.

BRIEF DESCRIPTION OF THE FIGURES

The accompanying drawings, which are incorporated herein and form a part of the specification, illustrate the present disclosure and, together with the description, further serve to explain the principles thereof and to enable a person skilled in the pertinent art to make and use the same.

DETAILED DESCRIPTION

Figure 1:
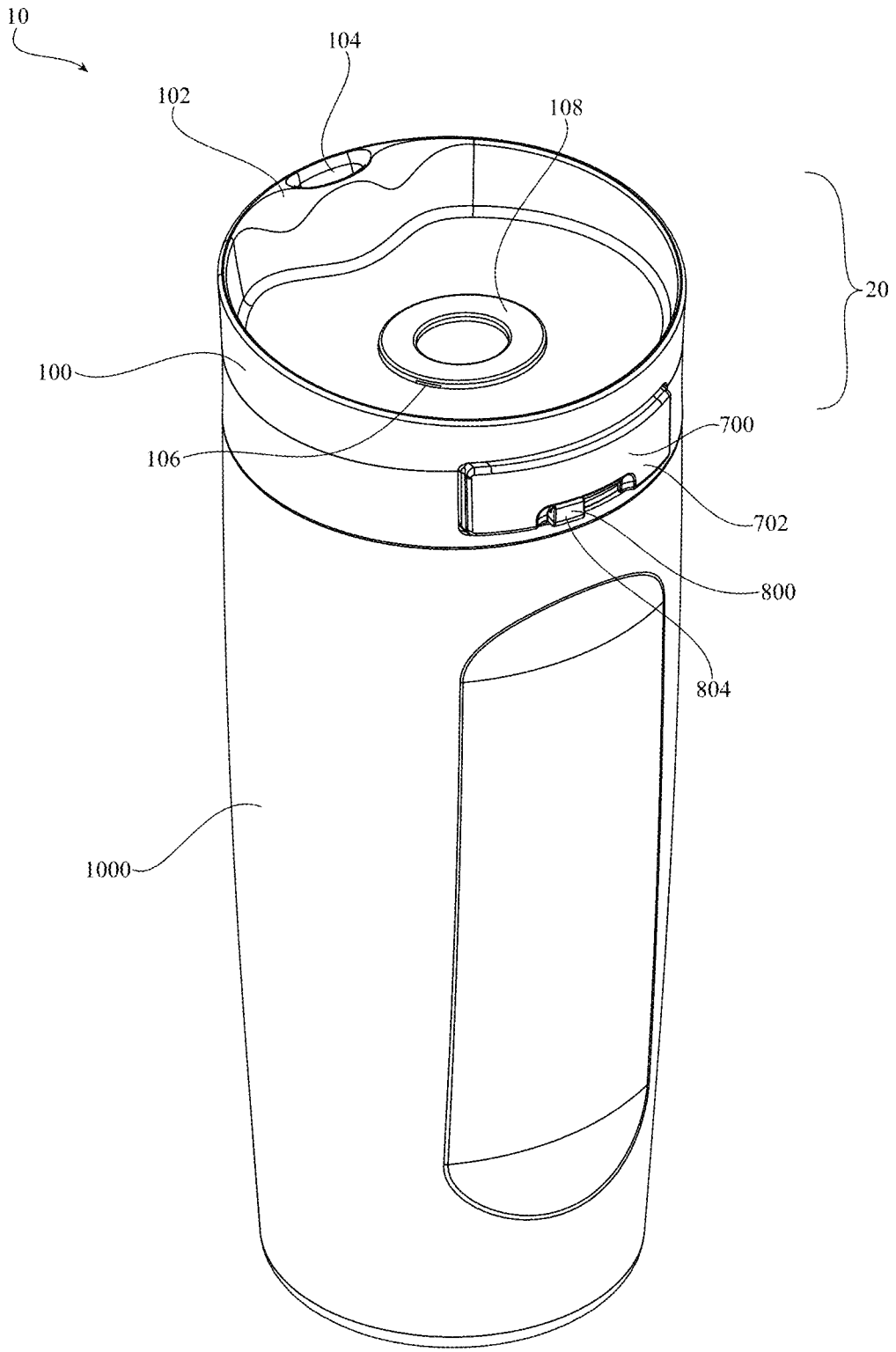
FIG. 1 shows an upper rear perspective view of a drinking vessel.

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein comport with standards used by those experienced or skilled in the art to most effectively convey the substance of their work to others skilled in the art. In some instances, well-known methods, procedures, components, and elements have not been described in detail to avoid unnecessarily obscuring aspects of the disclosure.

References in the specification to "one embodiment," "an embodiment," "an example embodiment," "some embodiments," etc., indicate that the embodiment described may include a particular feature, structure, or characteristic, but every embodiment may not necessarily include the particular feature, structure, or characteristic. Moreover, such phrases are not necessarily referring to the same embodiment. Further, this disclosure has been prepared such that when a particular feature, structure, or characteristic is described in connection with an embodiment, it is within the knowledge of one skilled in the art to apply such feature, structure, or characteristic in connection with other embodiments whether or not explicitly described.

The following examples are illustrative, but not limiting, of the present disclosure. Other suitable modifications and adaptations of the variety of conditions and parameters normally encountered in the field, and which would be apparent to those skilled in the art, are within the spirit and scope of the disclosure.

People use reusable drinking vessels to carry a variety of beverages. It is often desirable for a drinking vessel to have a sealing mechanism to seal a drinking opening of the drinking vessel when a user is not drinking from it. Sealing the drinking opening can, for example, allow a user to carry the drinking vessel without worrying that the beverage being carried will leak on the user or the user's belongings. Sealing the drinking opening can also, for example, allow the beverage being carried to maintain a desired temperature. Users may appreciate a drinking vessel that can be easily sealed and unsealed so that the user can easily drink from the drinking vessel.

It may also be desirable for a drinking vessel to have relatively few components that come into contact with a beverage contained in or consumed through the drinking vessel. This may be desirable, for example, so that dirt or debris on certain components does not contaminate a beverage within the drinking vessel or so that there are relatively few component for a user to clean (e.g., to remove beverage deposits from the components).

Some embodiments of the present disclosure provide a lid for a beverage container that can be used to easily seal and unseal a drinking opening. Several of the components are isolated from an interior volume of the drinking vessel such that a beverage carried inside the drinking vessel or consumed through the drinking vessel do not contact the components. The lid includes a movable arm that moves in response to a magnetic force to seal and unseal a drinking opening. The lid also includes an actuator (e.g., a button) accessible from an exterior of the lid. Two magnet units are located on the movable arm, and another magnet unit is located on the button. When the button is in an unpressed position, a magnetic force (e.g., an attractive force) between the magnet unit on the button and one of the magnet units on the movable arm holds the movable arm in the sealed position. When the button is in the pressed position, a magnetic force (e.g., a repulsive force) between the magnet unit on the button and the other magnet unit on the movable arm holds the movable arm in the open position.

In some embodiments, only one magnet unit is located on the movable arm. In some such embodiments, when the button is in the unpressed position, a magnetic force (e.g., an attractive force) between the magnet unit on the button and the magnet unit on the movable arm holds the movable arm in the sealed position. In other such embodiments, when the button is in the pressed position, a magnetic force (e.g., a repulsive force) between the magnet unit on the button and the magnet unit on the movable arm holds the movable arm in the open position.

In some embodiments, when a user presses the button, the resulting movement of a magnet unit located on the button changes a magnetic force on the movable arm, thereby causing the movable arm to move (e.g., toward an open position). In some embodiments, when a user releases the button, the resulting movement of the magnet unit located on the button changes the magnetic force on the movable arm, thereby causing the movable arm to move (e.g. toward a sealing position).

In some embodiments, the button is biased toward the unpressed position such that the button automatically moves to the unpressed position upon removal of a force holding the button in the pressed position. In some embodiments, a magnetic interaction between a magnet unit on the button and a magnet unit on the movable arm biases the button toward the unpressed position.

In some embodiments, the movable arm is biased toward one of the sealed position or the open position, and pressing the button causes a force between a magnet unit on the button and a magnet unit on the movable arm to overcome the bias of the movable arm. For example, the movable arm may be biased toward the sealed position, and pressing the button may cause a force between the magnet unit on the button and a magnet unit on the movable arm to overcome the bias, thereby moving the movable arm away from the sealed position.

In some embodiments, the actuator may be locked so that the drinking opening is not accidentally unsealed.

These and other embodiments are discussed below in more detail with reference to the figures.

Figure 2:
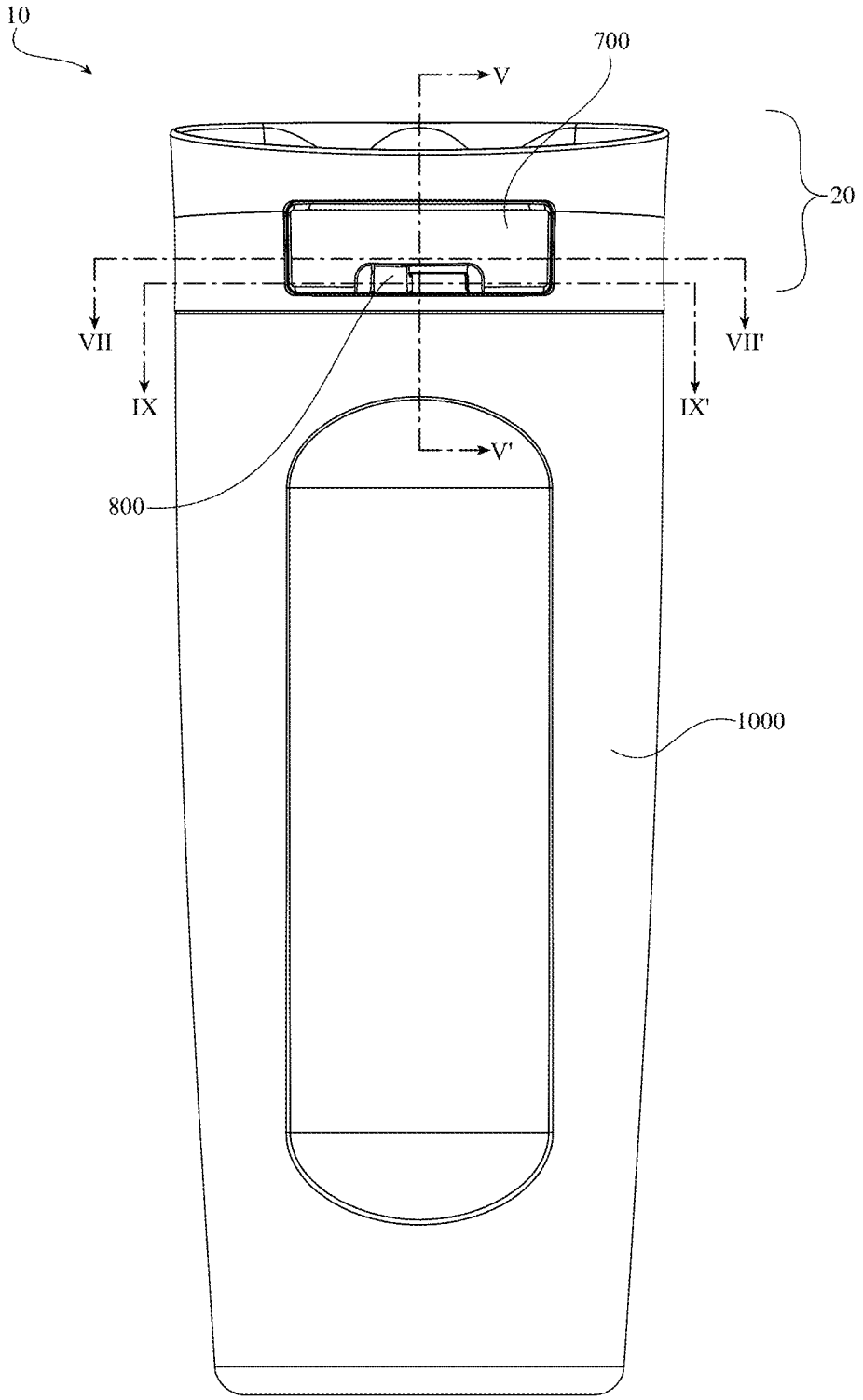
FIG. 2 shows a rear view of the drinking vessel of FIG. 1.

FIGS. 1-2 show a drinking vessel 10 according to some embodiments. Drinking vessel 10 may include a container 1000 and a lid 20 for container 1000. Lid 20 may include multiple components, including a lid base 100 and an actuator 700.

Lid base 100 may include a drinking opening 104 through which a user can drink a beverage contained within container 1000 when lid 20 is assembled with container 1000. Lid base 100 may also include a vent opening 106 through which an interior volume of container 1000 can vent when lid 20 is assembled with container 1000. Lid base 100 may be formed of food-grade plastic (e.g., polypropylene, copolyester, the copolymer sold as Eastman Tritan, high-density polyethylene (HDPE), polyoxymethylene (POM), or acrylonitrile butadiene styrene (ABS)), or metal (e.g., steel, stainless steel, aluminum, copper, or titanium), and may be formed as a single, unitary piece.

Lid 20 when assembled with container 1000 can create a seal. The term seal as used here and elsewhere in this document does not necessarily require a perfect hermetic seal; rather a seal capable of inhibiting passage of liquid fluid is sufficient. Drinking opening 104 and vent opening 106 may be the only openings extending though lid base 100 to container 1000, and drinking opening 104 and vent opening 106 may be sealed in some configurations, as will be discussed in greater detail below.

Actuator 700 may be accessible from an exterior of lid base 100. Actuator 700 may be or include, for example, a button 702 (as shown in FIG. 1), a switch, a lever, or other suitable mechanical mechanism. Actuator 700 may be moveable between a first position and a second position in order to seal or unseal drinking opening 104, as will be discussed in greater detail below. Additionally or alternatively, actuator 700 may be moveable between a first position and a second position in order to seal or unseal venting opening 106.

In embodiments where actuator 700 is or includes a button 702, actuator 700 may be moveable from the first position to the second position, for example, by pressing button 702, and from the second position to the first position, for example, by releasing button 702. Actuator 700 may be formed of any suitable material (e.g., polypropylene, copolyester, the copolymer sold as Eastman Tritan, high-density polyethylene (HDPE), polyoxymethylene (POM), or acrylonitrile butadiene styrene (ABS)), glass, or metal (e.g., steel, stainless steel, aluminum, copper, or titanium), and may be formed as a single, unitary piece.

In some embodiments, lid 20 includes a locking member 800 to inhibit movement of actuator 700 and thereby inhibit opening of drinking opening 104. A user may move locking member 800 from an unlocked position to a locked position, for example, by engaging a portion of locking member 800 (e.g., nub 804) and sliding locking member 800 (e.g., in a counterclockwise direction about a locking axis 80 (see FIG. 4), viewed from the top of lid 20). When locking member 800 is in the locked position, actuator 700 is inhibited from moving from the first position to the second position to unseal drinking opening 104. When locking member 800 is in the unlocked position, actuator 700 is free to move from the first position to the second position.

In some embodiments, a user may move locking member 800 from an unlocked position or a locked position to a disassembly position, for example, by engaging a portion of locking member 800 and sliding locking member 800 (e.g., in a clockwise or counterclockwise direction about locking axis 80). When locking member 800 is in the disassembly position, actuator 700 can be removed from lid base 100.

Locking member 800 may be movable from each of its positions—e.g., unlocked position, locked position, and disassembly position—to each of its other positions.

Figure 3:
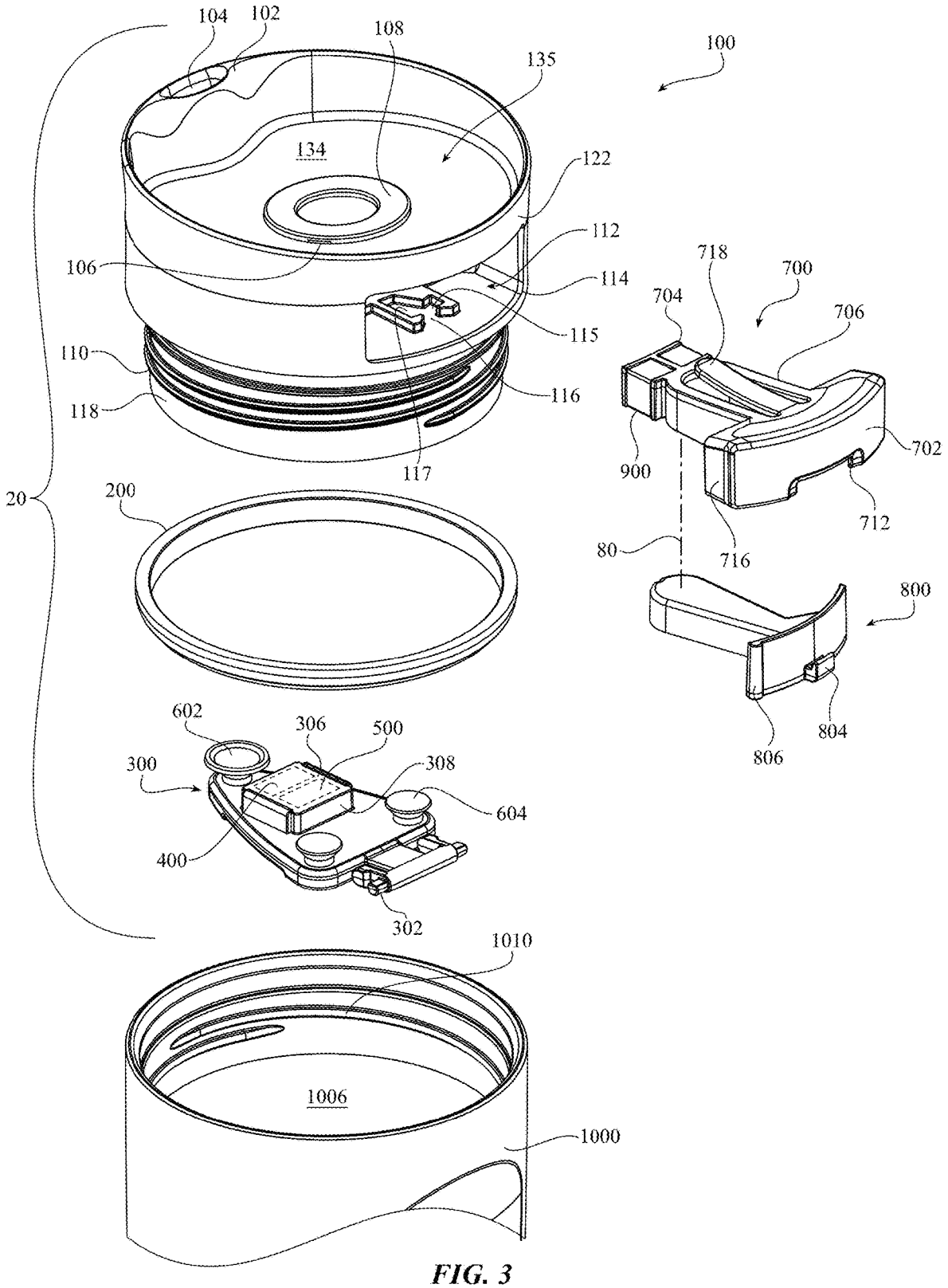
FIG. 3 shows an exploded upper rear perspective view of a portion of the drinking vessel of FIG. 1.
Figure 4:
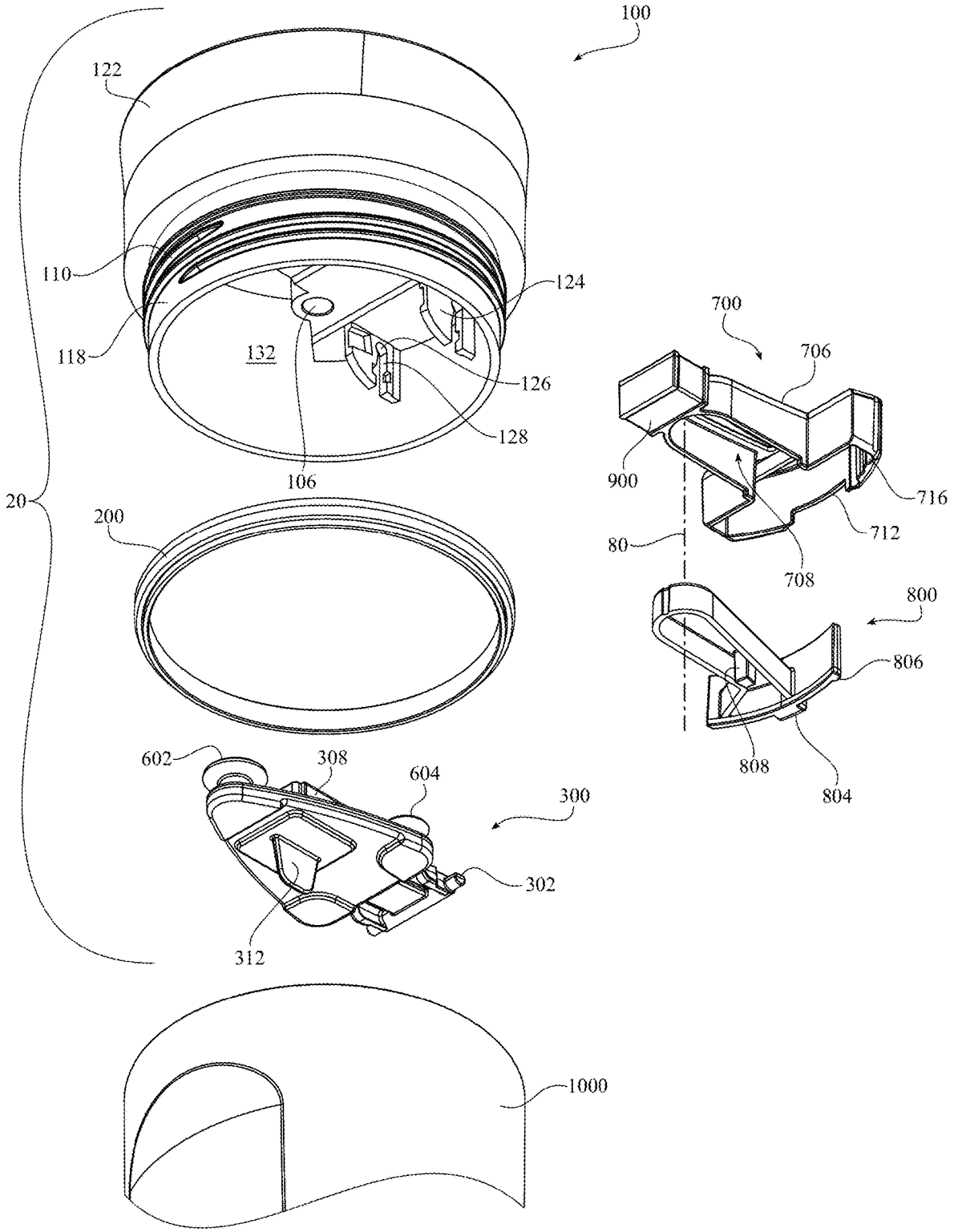
FIG. 4 shows an exploded lower front perspective view of a portion of the drinking vessel of FIG. 1.

FIGS. 3 and 4 show exploded views of drinking vessel 10 according to some embodiments. As shown, lid 20 includes lid base 100, actuator 700, a magnet unit 900, locking member 800, a lid sealing member 200, a movable arm 300, a magnet unit 400, and a magnet unit 500. Drinking vessel 10 may also include container 1000.

Lid base 100 may define a spout 102 through which drinking opening 104 extends. Lid base 100 may also define one more venting openings 106. Venting opening 106 may extend between an interior 132 of lid base 100 and an exterior 134 of lid base 100. Lid base 100 may include a vent cover 108 such that venting opening 106 is at least partially obscured from view.

Lid base 100 may define an actuator chamber 112. Actuator 700 may be positioned at least partially within actuator chamber 112 and may be accessible from the exterior of lid base 100. For example, as shown in FIG. 1, a portion of actuator 700 may protrude through an opening 114 in upper side wall 122 of lid base 100. Actuator 700 may be movable (e.g., slidable) within actuator chamber 112 between a first position and second position (e.g., by pressing and releasing actuator 700 as a button).

In some embodiments, actuator 700 may include a spring finger 718 in contact with a portion of lid base 100 when lid 20 is assembled. Spring finger 718 may help hold actuator 700 within actuator chamber 112 and/or reduce noise produced by lid 20 when actuator 700 moves with respect to lid base 100.

In some embodiments, actuator 700 is removable from actuator chamber 112. Actuator 700 may include, for example, a grip 716 to aid in removing actuator 700 from actuator chamber 112.

As shown, for example, in FIG. 3, actuator 700 may include a compartment 704 to receive magnet unit 900.

Magnet unit 900 may be or include one or more magnets. In some embodiments magnet unit 900 includes an outer housing containing one or more magnets therein.

Compartment 704 may be spaced a distance away from a contact surface of actuator 700 (e.g., button 702) by a center portion 706 such that magnet unit 900 is spaced away from an outer edge of lid base 100 when lid 20 is assembled. In the illustrated embodiment, for example, magnet unit 900 is spaced away from a rear edge of lid base 100.

In some embodiments, magnet unit 900 is joined with actuator 700 with an adhesive. In some embodiments, magnet unit 900 is joined with actuator 700 by other chemical bonding (e.g., by welding, molding, or potting) and/or mechanical means (e.g., a press or snap fit).

Compartment 704 may be configured such that magnet unit 900 is at or near a lower surface of actuator 700 when magnet unit 900 is received in compartment 704. In this way, a magnetic field generated by magnet unit 900 will be relatively strong at a location just below the lower surface of actuator 700, compared to a magnetic field generated by magnet unit 900 if magnet unit 900 were positioned further above the lower surface of actuator 700.

As mentioned, in some embodiments lid base 100 includes locking member 800. In embodiments that include locking member 800, actuator 700 may include a recess 708 for receiving locking member 800, and locking member 800 may be movable within recess 708 when lid 20 is assembled. In some embodiments, locking member 800 may be rotatable within recess 708 when lid 20 is assembled. For example, as shown in FIG. 4, locking member 800 may be rotatable about locking member axis 80. As shown, for example, in FIG. 1, when lid 20 is assembled, a portion of locking member 800 (e.g., nub 804) may protrude through an opening 712 in actuator 700 so that a user can engage locking member 800 from the exterior of lid 20. A user may move locking member 800 between positions (e.g., from a locked position to an unlocked position) by engaging nub 804 and sliding locking member 800 (e.g., in a clockwise direction about locking axis 80, viewed from the top of lid 20).

In some embodiments, locking member 800 is movable between three positions—a locked position, an unlocked position, and a disassembly position. As will be discussed in more detail below, when locking member 800 is in the locked position, actuator 700 is inhibited from moving from the first position to the second position. When locking member 800 is in the unlocked position, actuator 700 is free to move from the first position to the second position. When locking member 800 is in the disassembly position, actuator 700 can be removed from lid base 100 (e.g., by pulling actuator 700 out of actuator chamber 112). In some embodiments, locking member 800 is movable between only two positions, for example, the locked position and the unlocked position.

Lid base 100 may include attachment mechanism 110 on a lower side wall 118 of lid base 100. Container 1000 may include a corresponding attachment mechanism 1010 near an upper edge of the container, configured to engage with attachment mechanism 110 to removably attach container 1000 to lid 20. Attachment mechanisms 110 and 1010 may be threaded connectors (as shown in FIG. 3), friction fit connectors, snap-fit connectors, or any other suitable releasable attachment mechanism. The attachment of lid base 100 to container 1000 is not limited to the arrangement shown in the figures. For example, in some embodiments, lid base 100 may attach over container 1000 rather than inside container 1000.

When assembled with container 1000, lid sealing member 200 may be pressed between lid base 100 and an inner surface of container 1000, to create a seal between lid 20 and container 1000. Lid sealing member 200 may be a removable component (e.g., a removable gasket), or may be an integrally-formed part of lid base 100 or container 1000.

Moveable arm 300 may be positioned in interior 132 of lid base 100 and be movably coupled to lid base 100. In the illustrated embodiment, for example, movable arm 300 is coupled to lid base 100 through engagement of one or more receiving portions 126 of lid base 100 and one more engaging portions 302 of movable arm 300.

Figure 7:
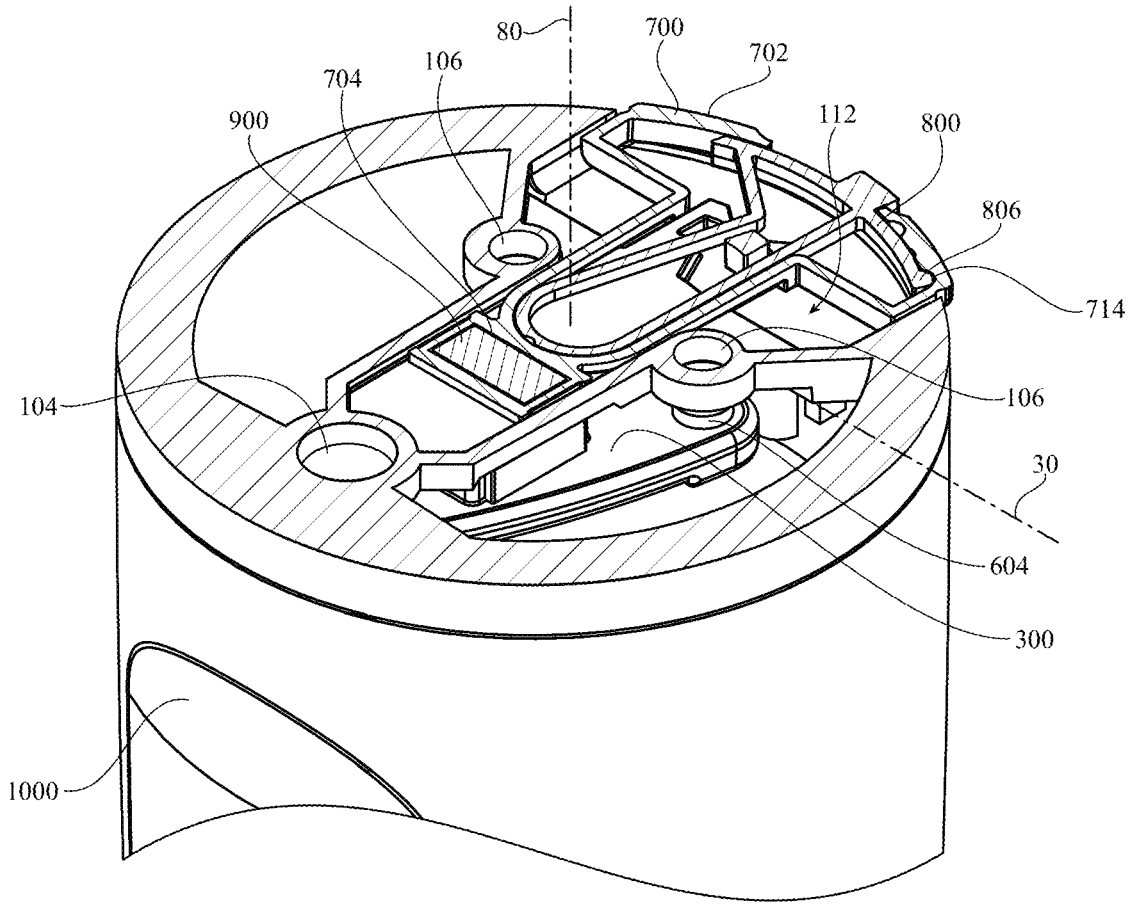
FIG. 7 shows a sectional view of a portion of the drinking vessel of FIG. 1, with an actuator of the drinking vessel in a first position and a movable arm of the drinking vessel in a sealed position, taken at the position of line VII-VII' of FIG. 2.
Figure 8:
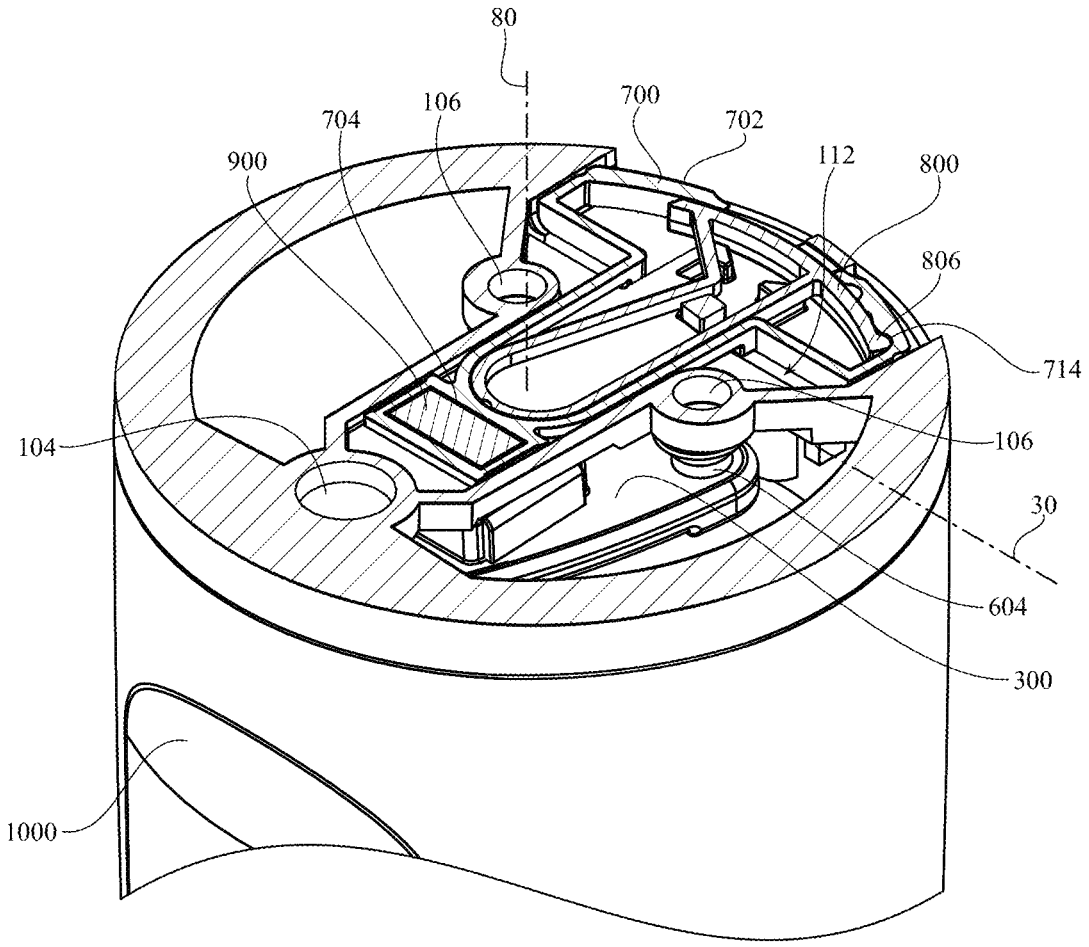
FIG. 8 shows a sectional view of a portion of the drinking vessel of FIG. 1, with an actuator of the drinking vessel in a second position and a movable arm of the drinking vessel in an open position, taken at the position of line VII-VII' of FIG. 2.

In some embodiments, movable arm 300 may be rotatable within lid base 100. For example, as shown in FIGS. 7-8, movable arm 300 may rotate about movable arm axis 30 extending through receiving portions 126 of lid base 100 and engaging portions 302 of movable arm 300. In some embodiments, for example as shown in FIG. 4, receiving portions 126 may have a circular shape, a channel 128 narrower than the diameter of the circular receiving portion 126 may extend down from receiving portions 126, and engaging portions 302 may be shaped as segments of a cylinder. In such embodiments, movable arm 300 can be assembled with lid base 100 by holding movable arm 300 in a vertical orientation (rotated 90 degrees counterclockwise from the orientation shown in FIG. 4), and sliding engaging portions 302 though channel 128 and into receiving portion 126. Movable arm 300 can then be rotated toward the horizontal orientation (shown, for example, in FIG. 4) in which channels 128 inhibit engaging portions 302 from sliding out of receiving portions 126. In this way, engaging portions 302 are held securely in receiving portions 126.

In other embodiments, movable arm 300 is movable relative to lid base 100 in another manner such as, for example, by sliding. Movable arm 300 may be formed of food-grade material.

Moveable arm 300 may include a drinking opening sealing portion 602. When lid 20 is assembled, drinking opening sealing portion 602 may move with movable arm 300 such that drinking opening sealing portion 602 seals drinking opening 104 when moveable arm 300 is in certain positions. Moveable arm 300 may include a vent sealing portion 604. When lid 20 is assembled, vent sealing portion 604 may move with movable arm 300 such that vent sealing portion 604 seals venting opening 106 when moveable arm 300 is in certain positions.

Figure 5:
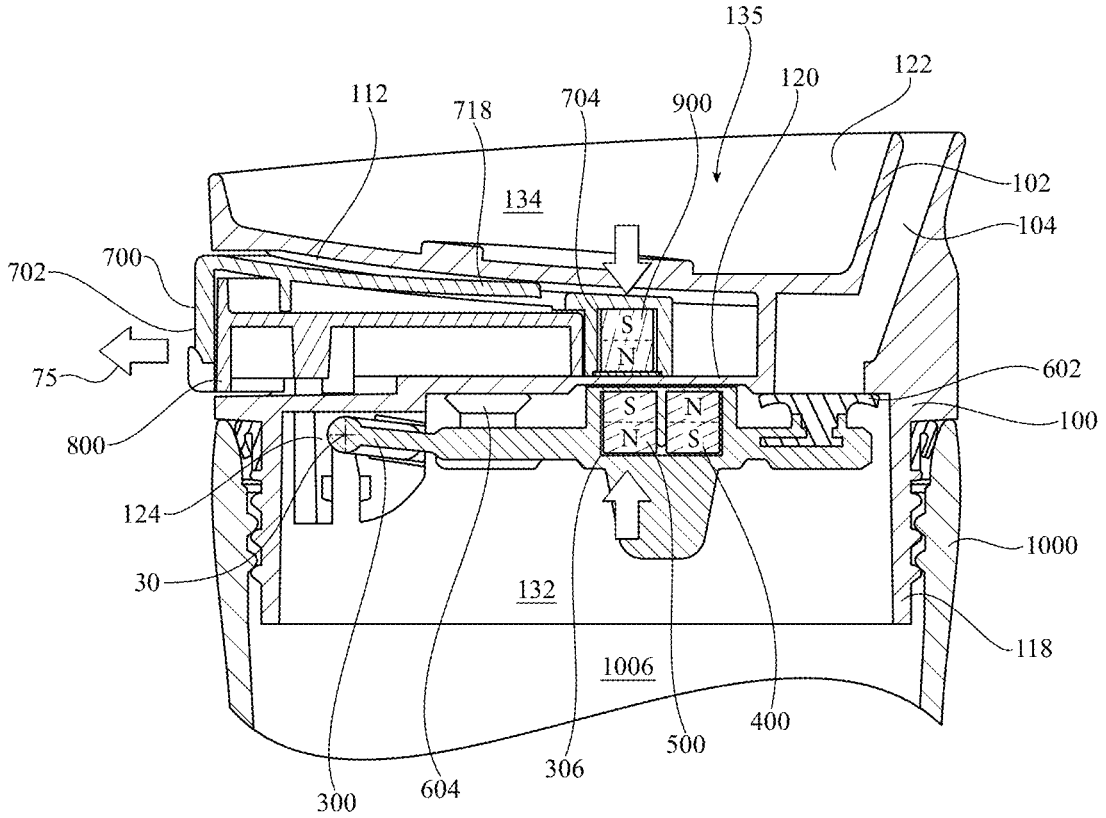
FIG. 5 shows a sectional view of a portion of the drinking vessel of FIG. 1, with an actuator of the drinking vessel in a first position and a movable arm of the drinking vessel in a sealed position, taken at the position of line V-V' of FIG. 2.
Figure 6:
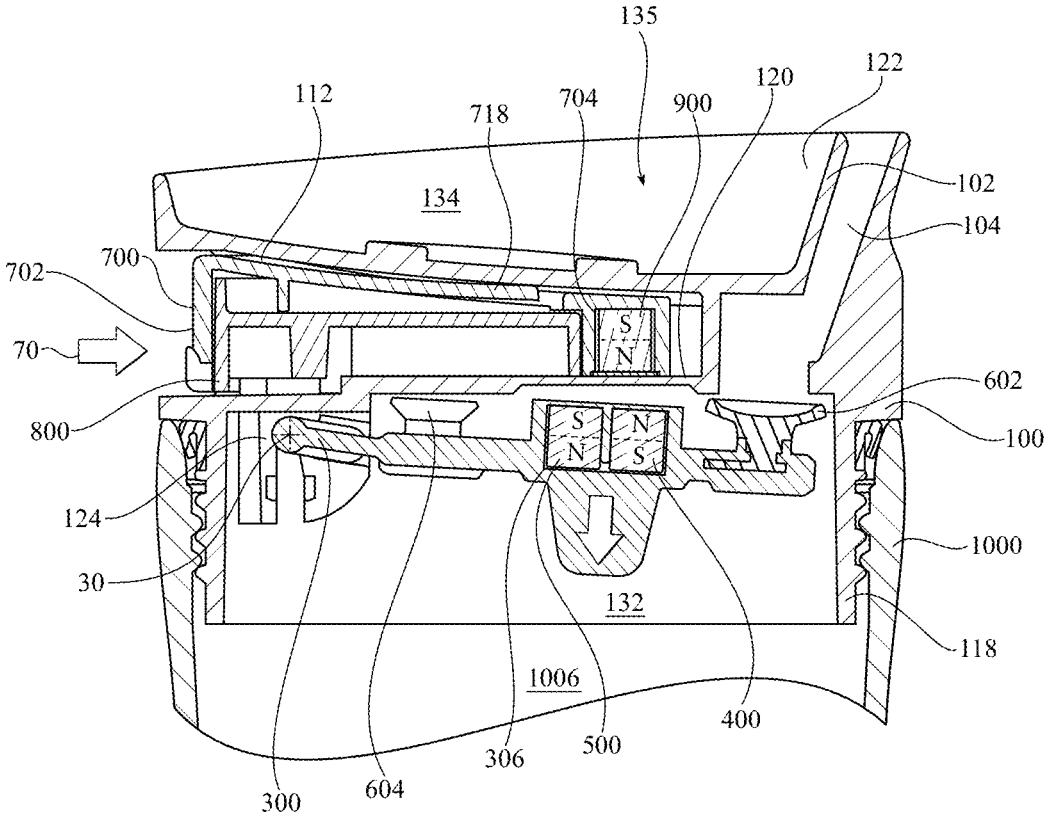
FIG. 6 shows a sectional view of a portion of the drinking vessel of FIG. 1, with an actuator of the drinking vessel in a second position and a movable arm of the drinking vessel in an open position, taken at the position of line V-V' of FIG. 2.

Movable arm 300 may be moveable relative to lid base 100 between a sealed position (as shown in FIG. 5) and an open position (as shown in FIG. 6). When movable arm 300 is in the sealed position, drinking opening 104 is sealed by drinking opening sealing portion 602. For example, drinking opening sealing portion 602 may press against a surface of or around drinking opening 104 to seal drinking opening 104. When movable arm 300 is in an open position, drinking opening sealing portion 602 does not seal drinking opening 104 (e.g., so that a user may drink from drinking vessel 10 through drinking opening 104).

In some embodiments, when movable arm 300 is in the sealed position, venting opening 106 is sealed by venting opening sealing portion 604. For example, venting opening sealing portion 604 may press against a surface of or around venting opening 106 to seal venting opening 106. In some embodiments, when movable arm 300 is in the open position, venting opening sealing portion 604 does not seal venting opening 106 (e.g., so that a user may vent drinking vessel 10 through venting opening 106).

In the illustrated embodiment, drinking opening sealing portion 602 is formed as a diaphragm. However, drinking opening sealing portion 602 may have any shape and configuration sufficient to seal drinking opening 104. For example, in other embodiments, drinking opening sealing portion 602 may be formed as a plug or gasket. Drinking opening sealing portion 602 may be integrally formed as part of movable arm 300 (for example, through co-molding) or may be or be a part of a separate component attached to movable arm 300. Drinking opening sealing portion 602 may be formed of a food-grade material suitable to create a seal between lid base 100 and movable arm 300.

In the illustrated embodiment, vent sealing portion 604 is formed as a diaphragm. However, vent sealing portion 604 may have any shape and configuration sufficient to seal vent opening 106. For example, in other embodiments, vent sealing portion 604 may be formed as a plug or gasket. Vent sealing portion 604 may be integrally formed as part of movable arm 300 (for example, through co-molding) or may be a separate component attached to movable arm 300. Vent sealing portion 602 may be formed of a food-grade material suitable to create a seal between lid base 100 and movable arm 300.

As shown, for example, in FIG. 3, movable arm 300 may include one or more compartments 306 for receiving magnet unit 400 and/or magnet unit 500.

In some embodiments, magnet unit 300 and magnet unit 400 are both located to the same side of a vertical plane passing through the rotation axis of the movable arm.

Magnet unit 400 may be or include one or more magnets. In some embodiments magnet unit 400 includes an outer housing containing one or more magnets therein. Magnet unit 500 may be or include one or more magnets. In some embodiments magnet unit 500 includes an outer housing containing one or more magnets therein.

Compartment 306 may be positioned in movable arm 300 such that magnet unit 400 and/or magnet unit 500 are spaced away from an outer edge of lid 20 when lid 20 is assembled. Compartment 306 may be configured such that magnet unit 400 and/or magnet unit 500 are positioned at or near an upper surface of movable arm 300 when magnet unit 400 and/or magnet unit 500 are received in compartment 306. In this way, a magnetic field generated by magnet unit 400 and/or magnet unit 500 will be relatively strong at a location just above moveable arm 300, compared to a magnetic field generated by magnet unit 400 and/or magnet unit 500 if magnet unit 400 and/or magnet unit 500 were positioned further below an upper surface of movable arm 300.

In some embodiments, magnet unit 400 and/or magnet unit 500 are joined with movable arm 300 with an adhesive. In some embodiments, magnet unit 400 and/or magnet unit 500 are joined with movable arm 300 by other chemical bonding (e.g., by welding, molding, or potting) and/or by mechanical means (e.g., a press fit). In some embodiments, movable arm 300 includes a magnet cover 308 to separate magnet units 400 and/or magnet unit 500 from interior 132 of lid base 100 when lid 20 is assembled. In some embodiments, magnet cover 308 is integrally formed with movable arm 300 (e.g., movable arm 300 may be molded in a first molding operation and magnet cover 308 may be formed in a second molding operation after magnet unit 400 and/or magnet unit 500 are joined with movable arm 300).

In some embodiments, moveable arm 300 may include a noise reduction portion (for example, a portion formed of silicone) to reduce noise when movable arm 300 moves from the sealed position to the open position or vice versa.

In some embodiments, movable arm 300 is removable from lid base 100. Movable arm 300 may include, for example, grip 312 to aid in removing movable arm 300 from lid base 100.

As will be discussed in greater detail below, when actuator 700 moves between the first position and second position (e.g., when actuator 700 is pressed, as a button), magnet unit 900, which is located in compartment 704 of actuator 700, moves from a first position to a second position, thereby changing the magnetic field experienced by magnet unit 400 and/or magnet unit 500. As a result, a magnetic force on magnet unit 400 and/or magnet unit 500 causes movable arm 300, which is coupled to magnet unit 400 and/or magnet unit 500, to move from a sealed position, in which drinking opening 104 is sealed, to an open position, in which drinking opening 104 is not sealed. Similarly, when actuator 700 moves from the second position to the first position (e.g., when actuator 700 is released, as a button), magnet unit 900 moves from a second position to a first position, thereby changing the magnetic field experienced by magnet unit 400 and/or magnet unit 500. As a result, a magnetic force on magnet unit 400 and/or magnet unit 500 causes movable arm 300 to move from the open position to the sealed position. In some embodiments, the movements may be reversed (i.e., such that moving actuator 700 from the first position to the second position causes movable arm 300 to move from the open position to the sealed position, and such that moving actuator 700 from the second position to the first position causes movable arm 300 to move from the sealed position to the open position).

Movable arm 300 may not be mechanically linked to actuator 700. That is, moving actuator 700 (e.g., from the first position to the second position or vice versa) would not exert any mechanical force on movable arm 300 (only magnetic force, as described herein).

Container 1000 may be any type of container. Container 1000 may be cylindrical (as shown, for example, in FIGS. 1-2) or have another exterior or interior shape. In some embodiments, container 1000 may be double-walled to enhance thermal insulative properties of container 1000. In some embodiments, an area between container 1000's double walls may be hermetically sealed and may form at least a partial vacuum. In some embodiments, container 1000 may be formed of stainless steel. In some embodiments, container 1000 may be formed of another food-grade material, such as a food-grade plastic (e.g., polypropylene, copolyester, the copolymer sold as Eastman Tritan, high-density polyethylene (HDPE), polyoxymethylene (POM), or acrylonitrile butadiene styrene (ABS)), glass, or another metal (e.g., steel, aluminum, copper, or titanium).

FIGS. 5-10 show detailed views of an embodiment for implementing some features as have been described. The specific structures and mechanisms shown and described (here and anywhere else in this document) may not be the only way to accomplish the functions described, and each element may be implemented using other shapes, structures, and appearances than specifically shown and described.

FIGS. 5-6 are cross-sectional views showing relative positions of certain components of lid 20 during operation. As mentioned above, during operation a user may move (e.g. slide) actuator 700 from a first position to a second position (e.g., by pressing actuator 700 like a button). FIGS. 5 and 7 show assembled cross-sectional views of an upper portion of drinking vessel 10 when actuator 700 is in the first position, and FIGS. 6 and 8 show assembled cross-sectional views of an upper portion of drinking vessel 10 when actuator 700 is in the second position. The sections in FIGS. 5 and 6 are taken vertically at the position of line V-V' of FIG. 2. The sections in FIGS. 7 and 8 are taken horizontally at the position of line VII-VII' of FIG. 2 offset from the top of lid 20.

As shown, for example, in FIG. 5, lid base 100 includes dividing wall 120. The illustrated dividing wall 120 curves upward toward the front of the lid base 100 to partially define spout 102. Spout 102 is located near the edge of lid base 100—offset from a center of lid base 100—so that it is in a comfortable location for a user when the user is drinking from the spout. As shown, drinking opening 104 extends through spout 102. Drinking opening 104 may have a stadium-shaped cross section at an upper portion of spout 102. In some embodiments, the cross sectional shape of drinking opening 104 may change from an upper portion of drinking opening 104 to a lower portion of drinking opening 104. Drinking opening 104 may have a circular cross section at a lower portion of drinking opening 104, as shown, for example, in FIG. 7. The lower portion of drinking opening 104 may have other shapes, such as a stadium or rectangular shape.

Lid base 100 includes a lower side wall 118 extending downward from a lower side of dividing wall 120. Together, lower side wall 118 and dividing wall 120 define an interior of 132 of lid base 100. When lid 20 is assembled with container 1000, interior 132 of lid base 100 is in fluid communication with an interior 1006 of container 1000. Lid base 100 may also include an upper side wall 122 that extends upward from an upper side of dividing wall 120. In some embodiments, upper side wall 122 and dividing wall 120 may define a cavity 135. However, in other embodiments, lid base 100 does not include a cavity 135. Drinking opening 104 extends through dividing wall 120 and opens into interior 132 of lid base 100. Vent opening 106 extends through dividing wall 120 and opens into interior 132 of lid base 100 and exterior 134 of lid base 100. Vent opening 106 may be positioned to a side of actuator chamber 112 so that vent opening 106 does not interfere with actuator 700.

Actuator 700 may extend within actuator chamber 112 from a rear of lid base 100 toward a front of lid base 100. Actuator 700 and actuator chamber 112 may be isolated from interior 132 of lid base 100 and drinking opening 104 such that a beverage carried inside container 1000 and/or consumed by a user through drinking opening 104 will not contact actuator 700 or actuator chamber 112. This isolation may be desirable, for example, so that dirt or debris on actuator 700 or in actuator chamber 112 is not likely to contaminate a beverage within container 1000. The isolation may also be desirable so that, for example, actuator 700 does not become soiled with deposits from a beverage carried within container 1000.

Movable arm 300 may extend from a rear of lid base 100 toward a front of lid base 100 in an interior of lid base 100. As discussed above with reference to FIG. 4, movable arm 300 may be movably coupled to lid base 100 such that movable arm 300 is rotatable about movable arm axis 30. For example, movable arm 300 may be movably coupled to lid base 100 at mounting portion 124 extending downward from dividing platform 120 of lid base 100. In the illustrated embodiment, mounting portion 124 includes receiving portions 126, and moveable arm 300 includes corresponding engaging portions 306. Engaging portions 306 of moveable arm 300 are received into receiving portions 126 of mounting portion 124, thereby allowing moveable arm 300 to rotate about movable arm axis 30 (see, e.g., FIG. 7). For example, moveable arm 300 may rotate from the sealed position (as shown, for example in FIGS. 5 and 7) to the open position (as shown, for example, in FIGS. 6 and 8). In some embodiments, moveable arm 300 may move in a different manner. For example, moveable arm may move translationally forward and backward and/or up and down.

When movable arm 300 is in the sealed position, for example, as shown in FIG. 5, drinking opening 104 is sealed by drinking opening sealing portion 602. Drinking opening sealing portion 602 is positioned below drinking opening 104 and may be located on and move along with moveable arm 300. In some embodiments, drinking opening sealing portion 602 may seal drinking opening 104 by pressing against dividing wall 120 through which drinking opening 104 extends.

In some embodiments, when movable arm 300 is in a sealed position, vent opening 106 is sealed by vent sealing portion 604 of sealing member 600. Vent sealing portion 604 is positioned below vent opening 106 and may be located on and move along with moveable arm 300. In some embodiments, vent sealing portion 604 may seal vent opening 106 by pressing against dividing wall 120 through which vent opening 106 extends.

In some embodiments, moveable arm 300 can be moved (e.g., rotated) by applying a force (e.g., a magnetic force) to movable arm 300. As can be seen, for example, in FIGS. 5-6, application of a downward force to a front portion of movable arm 300 (relative to axis 30) may move movable arm 300 in a first rotational direction away from the sealed position, while application of an upward force to a front portion of moveable arm 300 (relative to axis 30) may move movable arm in a second rotational direction toward the sealed position.

As discussed above, in some embodiments, magnet unit 900 is positioned in compartment 704 of actuator 700 and magnet unit 400 and/or magnet unit 500 are positioned in compartment 306 of movable arm 300. In some embodiments, the location of magnet unit 900 and magnet unit 400 and/or magnet unit 500 may be reversed. That is, magnet unit 900 may be coupled to movable arm 300, and magnet unit 400 and/or magnet unit 500 may be coupled to actuator 700.

In the illustrated embodiment, magnet unit 900 is arranged such that a north pole of magnet unit 900 (labeled "N") is positioned at a bottom surface of actuator 700, magnet unit 400 is arranged such that a north pole of magnet unit 400 (labeled "N") is positioned at a top surface of movable arm 300, and magnet unit 500 is arranged such that a south pole of magnet unit 500 (labeled "S") is positioned at a top surface of movable arm 300. However, each of the arrangements may be reversed to achieve a desired magnetic interaction. That is, magnet unit 900 can be arranged such that a south pole of magnet unit 900 is positioned at a bottom surface of actuator 700, magnet unit 400 can arranged such that a south pole of magnet unit 400 is positioned at a top surface of movable arm 300, and/or magnet unit 500 can be arranged such that a north pole of magnet unit 500 is positioned at a top surface of movable arm 300.

As shown, for example, in FIG. 5, when actuator 700 is in the first position, magnet unit 500 coupled to movable arm 300 may interact with magnet unit 900 coupled to actuator 700. For example, magnet unit 500 may be attracted to magnet unit 900. In the illustrated embodiment, magnet unit 900 and magnet unit 500 are arranged such that a north pole of magnet unit 900 faces a south pole of magnet 500 when actuator 700 is in the first position. As a result, when actuator 700 is in the first position, magnet unit 900 applies an upward force on a front portion of movable arm 300, thereby pulling movable arm in a first rotational direction and maintaining movable arm 300 in the sealed position.

In FIG. 6, actuator 700 has been moved from the first position to the second position (e.g., by pushing button 702 toward the front of drinking vessel 10). In FIG. 6, actuator 700 has moved a short distance between the first and second positions. However, actuator 700 may be configured to translate more or less than shown in the figures. As shown, for example, in FIG. 6, when actuator 700 is in a second position, magnet unit 400 coupled to movable arm 300 may interact with magnet unit 900 coupled to actuator 700. For example, magnet unit 400 may be repelled by magnet unit 900. In the illustrated embodiment, magnet unit 900 and magnet unit 400 are arranged such that a north pole of magnet unit 900 faces a north pole of magnet unit 400 when actuator 700 is in the second position. As a result, when actuator 700 is in the second position, magnet unit 900 applies a downward force on a front portion of movable arm 300, thereby pushing movable arm in the second rotational direction and maintaining movable arm 300 in the open position.

In the illustrated embodiment, magnet unit 400 and magnet unit 500 are provided on movable arm 300, thereby enabling actuator 700 to hold movable arm 300 in either the sealed position or the open position, depending on the position of actuator 700. In some embodiments, however, only one of magnet unit 400 or magnet unit 500 is provided on movable arm 300. In such an embodiment, magnet unit 900 coupled to actuator 700 may hold movable arm 300 in only one of the sealed position or the open position. In some such embodiments, a biasing member may bias movable arm 300 toward the other position.

As illustrated, for example, in FIGS. 5-6, when a force (represented by arrow 70 in FIG. 6) is applied to actuator 700 in a direction generally toward the front of vessel 10, actuator 700 and coupled magnet unit 900 move toward a front of vessel 10. As magnet unit 900 moves toward a front of vessel 10, a magnetic force on magnet unit 400 changes. For example, in the illustrated embodiment, as magnet unit 900 moves toward the front of vessel 10, magnet unit 400 may experience an increasing repulsive force, thereby causing movable arm 300 to move in a second rotational direction toward the open position. The force represented by arrow 70 may, for example, be applied by a user pushing on a contact surface (e.g., button 702) of actuator 700.

In some embodiments, as illustrated, for example, in FIGS. 5-6, a biasing force may bias actuator 700 toward the first position (e.g., in the direction of arrow 75 in FIG. 5) such that actuator 700 automatically moves to the first position upon removal of a force holding actuator 700 in the second position (e.g., upon removal of a force applied by a user to button 702).

In some embodiments, a magnetic interaction between magnet unit 900 coupled to actuator 700 and magnet unit 500 coupled to movable arm 300 may bias actuator 700 toward the first position. For example, in the illustrated embodiment, actuator 700 is biased to return to (or remain in) the first position by magnet unit 500. As shown, for example, in FIG. 6, when actuator 700 is in the second position, magnet unit 900 interacts with both magnet unit 400 and magnet unit 500. Due to the relative strength and positioning of magnet units 900, 400, and 500, magnet unit 900 will move toward magnet unit 500 in the absence of a force holding actuator 700 in the second position. Because actuator 700 is only free to translate, however, magnet 900 along with actuator 700 will translate toward a rear of vessel 10.

In other embodiments, actuator 700 may be biased to return to (or remain in) the first position by a physical component, e.g., a compression spring or elastic material that pushes actuator 700 to the first position. In some embodiments, actuator 700 may be biased toward the second position rather than the first position.

In some embodiments, a user may apply a force to a portion of actuator 700 to move (e.g., translate) actuator 700. Generally, the force applied by a user may overcome the biasing force (e.g., a force applied by a user to move actuator 700 from the first position to the second position may overcome a biasing force biasing actuator 700 toward the first position).

As mentioned, in some embodiments, a biasing force may move actuator 700 from the second position to the first position (e.g., in the direction of arrow 75 generally toward the rear of vessel 10). In other embodiments, a user-applied force may move actuator 700 from the second position to the first position (e.g., in the direction of arrow 75 generally toward the rear of vessel 10). As illustrated, for example, in FIGS. 5-6, when actuator 700 moves in a direction generally toward the rear of vessel 10, actuator 700 and coupled magnet unit 900 move toward a rear of vessel 10. As magnet unit 900 moves toward a rear of vessel 10, a magnetic force on magnet unit 500 changes. For example, in the illustrated embodiment, as magnet unit 900 moves toward the rear of vessel 10, magnet unit 500 may experience an increasing attractive force, thereby causing movable arm 300 to move in a first rotational direction toward the sealed position.

In some embodiments, movable arm 300 is biased toward a biased position, which may be one of the sealed position or the open position. In the illustrated embodiment, for example, movable arm 300 is biased toward the sealed position. That is, in the absence of a mechanical force on a component of lid 20, movable arm 300 will return to (or remain in) the sealed position. In embodiments in which movable arm 300 is biased toward a biased position, moving actuator 700 may cause a magnetic interaction that overcomes the bias. For example, in the illustrated embodiment, when movable arm 300 is in its biased position (i.e., the sealed position), moving actuator 700 from the first position to the second position causes magnet unit 900 to interact with magnet unit 400, as discussed above, such that the bias of movable arm 300 may be overcome and movable arm 300 moves to the open position.

Under some circumstances, pressure may build up inside drinking vessel 10, for example when drinking vessel 10 is used to carry a hot beverage. If a user attempts to open drinking opening 104 and/or vent opening 106 by moving actuator 700 to the second position in order to move movable arm 300 to the open position and if the pressure inside drinking vessel is sufficiently high, movable arm may not rotate to the open position. A user can then remove or loosen lid 20 from container 1000 to relieve the built-up pressure. In this way, the magnetic sealing mechanism helps reduce the possibility of an undesirable pressure release through a small opening.

Figure 9:
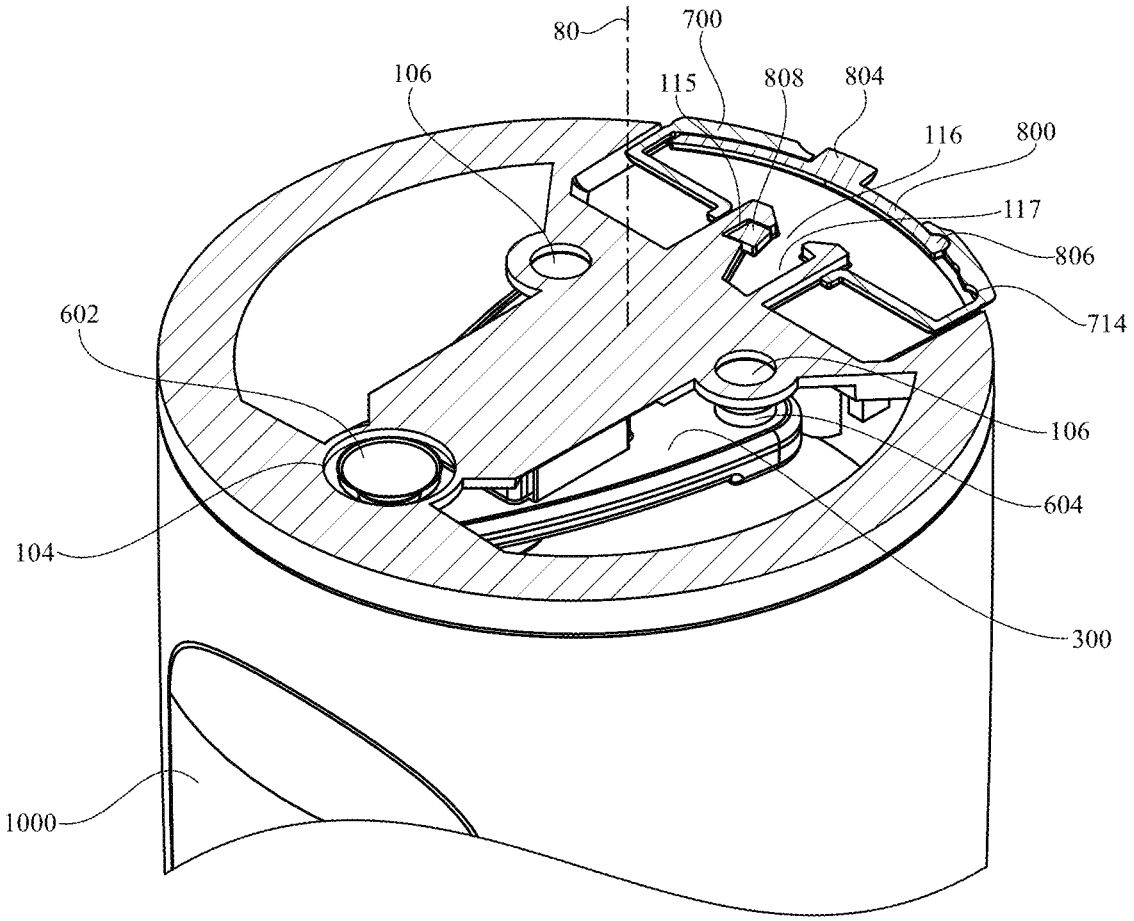
FIG. 9 shows a sectional view of a portion of the drinking vessel of FIG. 1, with a locking member of the drinking vessel in a locked position, taken at the position of line IX-IX' of FIG. 2.
Figure 10:
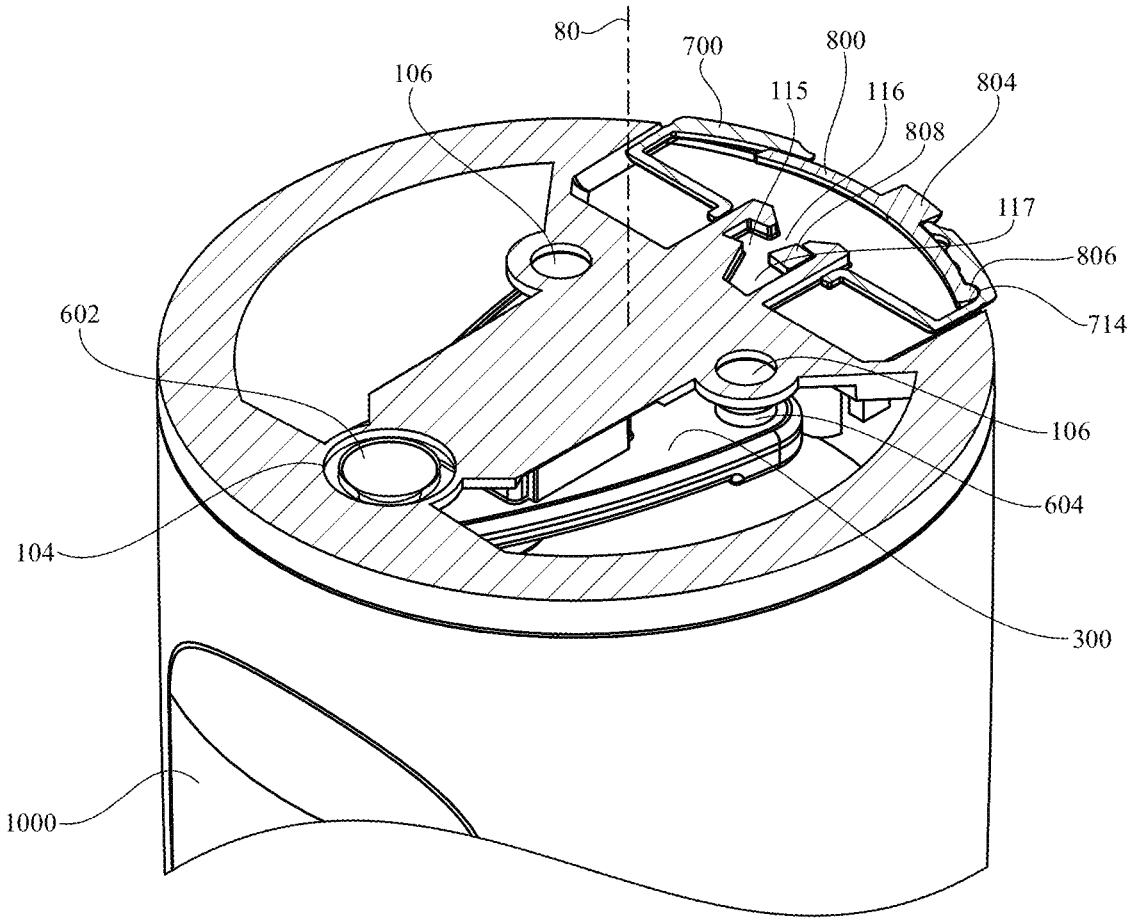
FIG. 10 shows a sectional view of a portion of the drinking vessel of FIG. 1, with a locking member of the drinking vessel in an unlocked position, taken at the position of line IX-IX' of FIG. 2.

As discussed previously, a user may sometimes want container 1000 to stay sealed. For example, a user may want container 1000 to stay sealed so that a beverage being carried inside container 1000 will not leak on a user or a user's belongings when drinking vessel 10 is placed in the user's backpack or other bag (where drinking vessel 10 may encounter forces from other items in the user's bag, or may change orientation). In such a situation (as in others), a user may be able to place vessel 10 in a locked configuration in which actuator 700 is inhibited from moving to the second position, thereby inhibiting actuator 700 from causing movable arm 300 to rotate to the open position. This locked configuration is shown in FIG. 9 and described in more detail below. FIGS. 9 and 10 show relative positions of portions of lid base 100, actuator 700, locking member 800, and other components of lid 20 when lid 20 is in two operational states: a locked configuration with actuator 700 in the first position (FIG. 9), and an unlocked configuration with actuator 700 in the first position (FIG. 10). In some embodiments, lid 20 may have a disassembly configuration. The sections in FIGS. 9 and 10 are taken horizontally at the position of line IX-IX' of FIG. 2 offset from the top of lid 20.

As discussed, lid base 100 may define an actuator chamber 112 into which actuator 700 and locking member 800 are positioned. As shown, for example, in FIG. 4, locking member 800 may have a post 808 extending from a lower portion of locking member 800. As shown, for example, in FIG. 3, a bottom portion of actuator chamber 112 may include a recess 117, a compartment 115, and a channel 116.

When lid 20 is in the locked configuration, for example, as shown in FIG. 9, post 808 is received in compartment 115. When a force is applied to actuator 700 in a direction generally toward the front of vessel 10, compartment 115 interferes with post 808, thereby inhibiting actuator 700 from moving to the second position.

When lid 20 is in the disassembly configuration, post 808 is received in recess 117 and is aligned with channel 116. When a force is applied to actuator 700 in a direction generally toward the rear of vessel 10, post 808 slides through channel 116 and out of actuator chamber 112. As a result, locking member 800 and actuator 700 can be removed from actuator chamber 112 of lid base 100. Removing actuator 700 and locking member 800 from lid base 100 may be desirable, for example, so that a user may thoroughly clean drinking vessel 10.

When lid 20 is in the unlocked configuration, for example, as shown in FIG. 10, post 808 is received in recess 117. When a force is applied to button 702 in a direction generally toward the front of vessel 10, post 808 generally does not interfere with edges of recess 117. Accordingly, actuator 700 can be moved from the first position to the second position.

Locking member 800 may be movable from each of its three positions—unlocked position, locked position, and disassembly position—to each of its other positions, for example, by engaging a portion of locking member 800 (e.g., nub 804) and sliding locking member (e.g., in a clockwise or counterclockwise direction about a locking axis 80). In the illustrated embodiment, lid 20 is in the locked position when locking member 800 is in the counterclockwise-most position, viewed from the top of lid 20, relative to actuator 700, lid 20 is in unlocked position when locking member 800 is in the clockwise-most position, viewed from the top of lid 20, relative to actuator 700, and lid 20 is in a disassembly position when locking member 800 is in an intermediate position relative to actuator 700. However, the unlocked position, locked position, and disassembly position may be provided at different relative positions of locking member 800 and actuator 700.

In some embodiments, actuator 700 may include one or more indentations 714 on an inner surface, and locking member 800 may include a bump 806 on an exterior surface. Bump 806 may interact with (e.g., be received by) indentation 716 to help maintain locking member 800 in the locked, unlocked, or disassembly position, as the case may be, and may provide a user with feedback during use. For example, as a user moves locking member 800 to a locked position, the user may hear a click or feel tactile feedback when locking member 800 reaches the locked position (e.g., resulting from bump 806 being received by indentation 716). In some embodiments, the positions of bump 806 and indentation 716 may be reversed (i.e., such that actuator 700 includes a bump and locking member 800 includes a corresponding indentation).

It is to be appreciated that the Detailed Description section, and not the Summary and Abstract sections, is intended to be used to interpret the claims. The Summary and Abstract sections may set forth one or more but not all exemplary embodiments of the disclosed invention(s) as contemplated by the inventor(s), and thus, are not intended to limit the disclosed invention(s) and the appended claims in any way.

The foregoing description of the specific embodiments will so fully reveal the general nature of the claimed invention that others can, by applying knowledge within the skill of the art, readily modify and/or adapt for various applications such specific embodiments, without undue experimentation, without departing from the general concept of the claimed invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the claimed invention should not be limited by any of the above-described exemplary embodiments, but should be defined only in accordance with the claims and their equivalents.

What is claimed is:

1. A lid for a drinking vessel, the lid comprising:

a lid base defining a drinking opening therethrough;

a movable arm coupled to the lid base and located in an interior of the lid base;

a first magnet unit coupled to the movable arm;

an actuator accessible from an exterior of the lid base; and a second magnet unit coupled to the actuator, wherein the movable arm is movable between a sealed position, in which the drinking opening is sealed, and an open position, in which the drinking opening is not sealed, wherein the movable arm is biased toward a biased position, the biased position being one of the sealed position or the open position, wherein the actuator is movable between a first position and a second position, and wherein when the actuator is moved to the second position, a repulsive magnetic force between the first magnet unit and the second magnet unit overcomes the bias of the movable arm and causes the movable arm to move away from the biased position.

2. The lid of claim 1, wherein the movable arm is maintained away from the biased position while the actuator is in the second position, and the movable arm automatically returns to the biased position when the actuator is moved from the second position.

3. The lid of claim 1, wherein the actuator translates to move to and from the second position, and wherein the movable arm rotates to move between the sealed position and the open position.

4. The lid of claim 1, wherein the drinking opening extends between a lower volume and an upper volume of the lid base, and wherein the actuator is isolated from the lower volume and the upper volume of the lid base.

5. A drinking vessel comprising:

the lid of claim 1; and a container, wherein the lid is configured to attach to the container to close an interior volume of the container.

6. A method for sealing and unsealing a drinking opening of a lid, comprising:

pressing an actuator accessible from an exterior of a lid base to move it from a first position to a second position, wherein moving the actuator from the first position to the second position changes a magnetic force on a movable arm within the lid and thereby moves the movable arm to unseal the drinking opening due to one of magnetic attraction or magnetic repulsion; and moving the actuator from the second position to the first position, wherein moving the actuator from the second position to the first position changes the magnetic force on the movable arm and thereby moves the movable arm to seal the drinking opening due to the other of magnetic attraction or magnetic repulsion, wherein moving the actuator from the first position to the second position comprises pressing the actuator, and wherein moving the actuator from the second position to the first position occurs automatically upon releasing the actuator.

7. The method of claim 6, wherein a magnetic interaction between a first magnet unit coupled to the actuator and a second magnet unit coupled to the movable arm changes the magnetic force on the movable arm.

8. The method of claim 6, wherein moving the movable arm to seal the drinking opening comprises rotating the movable arm in a first rotational direction about an axis, and wherein moving the movable arm to unseal the drinking opening comprises rotating the movable arm in a second rotational direction about the axis.

9. The method of claim 6, wherein the drinking opening extends between a lower volume and an upper volume of the lid base, wherein the movable arm is located within the lower volume of the lid base, wherein the actuator is located between the lower volume and the upper volume of the lid base, and wherein the actuator is isolated from the lower volume and the upper volume of the lid base.

10. The lid of claim 1, wherein the repulsive magnetic force between the first magnet unit and the second magnet unit overcomes the bias of the movable arm and causes the movable arm to move away from the biased position.

11. The lid of claim 2, wherein a repulsive magnetic force between the first magnet unit and the third magnet unit maintains the movable arm away from the biased position while the actuator is in the second position.

12. The lid of claim 3, wherein the drinking opening is positioned at a front of the lid, and wherein the actuator translates horizontally toward the front of the lid to move between the first position and the second position.

13. The lid of claim 1, wherein the drinking opening is positioned at a front of the lid, and wherein the actuator can be moved to the second position by pressing a portion of the actuator located at a rear of the lid.

14. The lid of claim 1, wherein the actuator is biased toward the first position such that the actuator automatically moves from the second position to the first position upon removal of a force holding the actuator in the second position.

15. The lid of claim 1, wherein the lid base defines an actuator chamber, and the actuator is positioned at least partially within the actuator chamber.

16. The lid of claim 1, wherein the lid base defines a vent opening therethrough, wherein when the movable arm is in the sealed position, the vent opening is sealed, and wherein when the movable arm is in the open position, the vent opening is not sealed.

17. The lid of claim 1, wherein the movable arm is not mechanically linked to the actuator.

18. The lid of claim 16, wherein the biased position is the sealed position.

19. The drinking vessel of claim 5, wherein when the lid is attached to the container, the movable arm is located inside the interior volume of the container, and the actuator is located outside the interior volume of the container.

20. The method of claim 7, wherein a repulsive magnetic force between the first magnet unit and the second magnet moves the movable arm to unseal the drinking opening when the actuator is moved from the first position to the second position.

21. The lid of claim 1, wherein the actuator is positioned on the lid base.

22. The method of claim 6, wherein pressing the actuator to move it from the first position to the second position comprises horizontally translating the actuator.

* * * * *